US011535815B2

(12) United States Patent
Narayan et al.

(10) Patent No.: US 11,535,815 B2
(45) Date of Patent: Dec. 27, 2022

(54) GLYCERIN ETHOXYLATE AS AN ACTIVE INGREDIENT IN REMOVING MAKE-UP STAIN

(71) Applicant: SABIC GLOBAL TECHNOLOGIES B.V., Bergen Op Zoom (NL)

(72) Inventors: Karumanassery Chidambara Iyer Narayan, Riyadh (SA); Flaiyh Farhan N. Al-Anazi, Riyadh (SA); Mohammed S. Bakalla, Riyadh (SA); Qasem Ahmed A. Ghazwani, Riyadh (SA)

(73) Assignee: SABIC GLOBAL TECHNOLOGIES B.V., Bergen Op Zoom (NL)

( * ) Notice: Subject to any disclaimer, the term of this patent is extended or adjusted under 35 U.S.C. 154(b) by 148 days.

(21) Appl. No.: 16/345,852

(22) PCT Filed: Oct. 30, 2017

(86) PCT No.: PCT/IB2017/056745

§ 371 (c)(1),
(2) Date: Apr. 29, 2019

(87) PCT Pub. No.: WO2018/078604

PCT Pub. Date: May 3, 2018

(65) Prior Publication Data

US 2020/0172832 A1 Jun. 4, 2020

Related U.S. Application Data

(60) Provisional application No. 62/415,112, filed on Oct. 31, 2016.

(51) Int. Cl.
*C11D 1/00* (2006.01)
*C11D 1/831* (2006.01)
(Continued)

(52) U.S. Cl.
CPC ..... *C11D 1/831* (2013.01); *C11D 1/24* (2013.01); *C11D 1/72* (2013.01)

(58) Field of Classification Search
CPC ..... C11D 1/831; C11D 1/24
See application file for complete search history.

(56) References Cited

U.S. PATENT DOCUMENTS 3,929,678 A 12/1975 Laughlin et al.
4,098,713 A 7/1978 Jones
(Continued)

FOREIGN PATENT DOCUMENTS

CN 1207760 2/1999
EP 1479754 A1 11/2004
(Continued)

OTHER PUBLICATIONS

Bajpai, Divya et al., "Laundry Detergents: An Overview", Journal of Oleo Science, vol. 56, No. 7, 2007; pp. 327-340.
(Continued)

*Primary Examiner* — Necholus Ogden, Jr.
(74) *Attorney, Agent, or Firm* — Womble Bond Dickinson (US) LLP

(57) ABSTRACT

A composition for removing a cosmetic material from a substrate includes glycerin ethoxylate and linear alkyl benzene sulfonate (LABS). An application of the composition to a stain including a deposit of a cosmetic material at a white polyester-cotton blend fabric to provide a stained polyester-cotton blend fabric exhibits an increased stain removal measured as reflectance observed at 460 nm by at least about 35% compared to a reflectance observed at the stained polyester-cotton blend fabric prior to the application. A treatment including the composition applied to the stained polyester-cotton blend fabric provides a reflectance at the stained polyester-cotton blend fabric that is greater than a
(Continued)

reflectance observed at a white polyester-cotton blend fabric stained with a deposit of a cosmetic material and that has been treated with either the glycerin ethoxylate alone or that has been treated with the linear alkyl benzene sulfonate alone.

3 Claims, 1 Drawing Sheet

(51) Int. Cl.
*C11D 1/24* (2006.01)
*C11D 1/72* (2006.01)

(56) References Cited

U.S. PATENT DOCUMENTS 4,116,885 A 9/1978 Derstadt et al.
4,153,570 A 5/1979 Hennemann et al.
4,316,824 A 2/1982 Pancheri
4,363,756 A 12/1982 Sepulveda et al.
4,704,233 A 11/1987 Hartman et al.
5,173,207 A 12/1992 Drapier et al.
5,425,891 A 6/1995 Pujol et al.
5,549,840 A 8/1996 Mondin et al.
5,904,735 A 5/1999 Gutierrez et al.
5,998,355 A 12/1999 Brumbaugh
6,423,678 B1 * 7/2002 Brumbaugh ..... A61K 8/40 510/235
6,903,064 B1 6/2005 Kasturi et al.
8,591,958 B2 * 11/2013 Omidbakhsh ..... C11D 3/2075 424/616
10,053,651 B2 * 8/2018 Scheibel ..... C11D 11/0094
2014/0343168 A1 11/2014 Griese et al.

FOREIGN PATENT DOCUMENTS

WO 2000043474 A2 7/2000
WO 2015094151 A1 6/2015
WO 2016191103 A1 12/2016

OTHER PUBLICATIONS

International Search Report for International Application No. PCT/IB2017/056745; International Filing Date: Oct. 30, 2017; dated Feb. 2, 2018; 5 pages.
Written Opinion for International Application No. PCT/IB2017/056745; International Filing Date: Oct. 30, 2017; dated Feb. 2, 2018, 9 pages.
Database GNPD [Online] Mintel; Jul. 1, 2011, "Shampoo", Database accession No. 1587544; 2 pages.
Database GNPD [Online] Mintel; May 1, 2007, "Flax and Chamomile Shampoo", Database accession No. 708185; 2 pages.
Office Action issued in counterpart Chinese Patent Application No. 201780066914X, dated Jul. 7, 2020.
*Fine Chemicals Technical Handbook*, edited by Huang Long, Central South University Press, 1994, p. 279 (No English Translation provided).
Office Action issued in Corresponding Chinese Application No. 201780066914.X, dated Mar. 15, 2021 (English Translation provided).

* cited by examiner

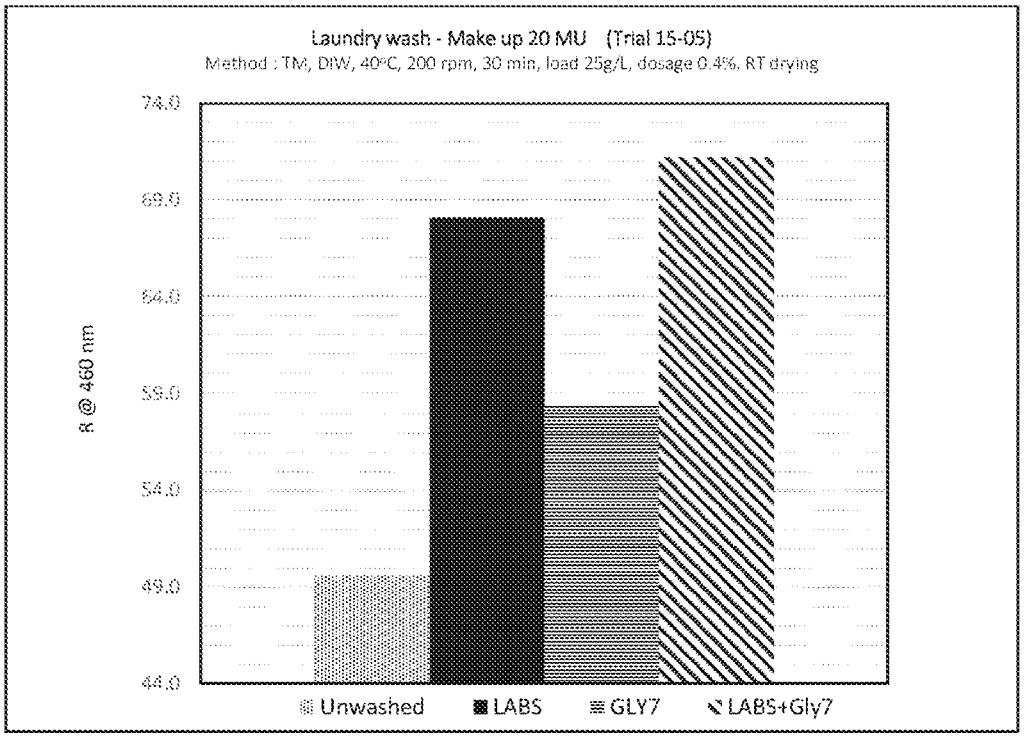
Laundry wash - Make up 20 MU (Trial 15-05)
Method : TM, DIW, 40°C, 200 rpm, 30 min, load 25g/L, dosage 0.4%, RT drying
R @ 460 nm
74.0
69.0
64.0
59.0
54.0
49.0
44.0
Unwashed
LABS
GLY7
LABS+Gly7

GLYCERIN ETHOXYLATE AS AN ACTIVE INGREDIENT IN REMOVING MAKE-UP STAIN

CROSS REFERENCE TO RELATED APPLICATIONS

This application is a 371 of International Application No. PCT/IB2017/056745, filed Oct. 30, 2017, which is incorporated by reference in its entirety, and which claims priority to U.S. Ser. No. 62/415,112, filed Oct. 31, 2016.

FIELD

The present disclosure relates to surfactant compositions for use in the removal of cosmetic material stains from fabrics.

BACKGROUND

Cosmetic (e.g. makeup) stains to clothing represent a common aggravation facing consumers. Such stains also represent a significant challenge with respect to removal during laundering. Ingredients forming cosmetics include a number of waxes, oils, pigments, chemicals and other ingredients and may include purified water, coconut oil derivatives such as sodium lauryl sulfate, sodium laureth sulfate, sodium coco sulfate, and cocamidopropyl betaine, decyl glucoside, citric acid, parabens, cetyl alcohol, vitamin E, beeswax, glycerin, oatmeal bran, shea butter, passion fruit juice, red rose water, raspberry extract, yucca herbal extract, aloe vera leaf gel, tea tree oil, peppermint leaf oil, wintergreen leaf oil, spearmint leaf oil, lavender oil, cinnamon leaf oil, lemon peel oil, Valencia orange peel oil, pink grapefruit peel oil, Roman chamomile oil, jasmine oil, extra virgin olive oil, saponified coconut oil (sodium cocoate), saponified palm oil (sodium palmate), hemp oil, jojoba oil, and sunflower oil. The preceding is intended to be an inexhaustive list of cosmetic ingredients.

Given the predominant use of cosmetics on the face and the proximity of the collar of clothing to the neck and face, stains from cosmetics on the collar occur with some frequency. In addition, the common habit of bringing hands to the face may also cause stains to the lower portions of sleeves or cuffs of a piece of apparel.

Cotton and polyester are two of the most commonly used fabrics to make clothing. Polyester-cotton fabric is a blend that is becoming increasingly popular, particularly with respect to athletic apparel. Given the natural production of perspiration during both normal daily activity and the increased production during exercise, applied cosmetics may be caused to run and ultimately stain the clothing worn during activity. Accordingly, there remains a need for a composition improving the removal of cosmetics from a polyester-cotton fabric.

The term surfactant combines surface-active agent into a single term to identify compounds used to lower the surface tension between two liquids or between a liquid and a solid. Surfactants are well known compounds and commonly used in a variety of activities such as cleaning, wetting, dispersing, and emulsification. Surfactants may also hold a critical functional capacity with respect to foaming and anti-foaming compounds. Common surfactant compositions for the removal of stains utilize formulations including carbonates, silicates, sulfates, and polymers, in addition to ethoxylated glycerin and linear alkyl benzene sulfonate. However, the use of these ingredients in compositions to remove cosmetic stains has been generally measured with respect to stains on polyester fabrics, rather than polyester blends such as polyester-cotton blends.

These and other shortcomings are addressed by aspects of the present disclosure.

SUMMARY

Aspects of the disclosure relate to a surfactant composition for the removal of cosmetic stains from a polyester-cotton fabric. The composition may include glycerin ethoxylate (GLY7) and linear alkyl benzene sulfonate (LABS) at about a 1:1 ratio by mass, where an application of the composition to a stain including a WFK 20MU deposit of cosmetic material at a white polyester-cotton blend fabric exhibits increased stain removal measured as reflectance at 460 nanometers (nm) by at least about 35% compared to a reflectance observed at the stained polyester-cotton blend fabric prior to application. A treatment of the strain removal composition applied to the stained polyester-cotton blend fabric provides a reflectance at the stained polyester-cotton blend fabric that is greater than a reflectance observed at a white polyester-cotton blend fabric stained with a WFK 20MU deposit of cosmetic material and that has been treated with either the glycerin ethoxylate alone or that has been treated with the linear alkyl benzene sulfonate alone.

An alternative surfactant composition includes glycerin ethoxylate (GLY7) and an anionic surfactant cooperating to remove cosmetic stains from a polyester-cotton blend fabric.

BRIEF DESCRIPTION OF THE DRAWINGS

The above-mentioned and other features and advantages of this disclosure, and the manner of attaining them, will become apparent and be better understood by reference to the following description of one aspect of the disclosure in conjunction with the accompanying drawings, wherein:

FIG. 1 shows a graphical representation of the reflectance values observed for compositions used in the laundry wash trial.

DETAILED DESCRIPTION OF ILLUSTRATIVE ASPECTS

For a variety of stains on clothing, surfactant compositions are used to treat the fabric and remove the deposit of material causing the stain. A surfactant composition including an ethoxylated alcohol and an anionic surfactant used to treat cosmetic, or makeup stains at a polyester-cotton fabric is disclosed.

Surfactant Compositions

Surfactant compositions are organic compounds having both hydrophilic groups and hydrophobic, or lipophilic, groups. Hydrophilic portions of the molecule form a head while the hydrophobic portion of the molecule forms a tail. As a result, each surfactant molecule has both water-soluble and water-insoluble or oil-soluble portions.

Generally, surfactants are classified as cationic, anionic, and nonionic according to the charge of the water-soluble head portion of the molecule. Cationic surfactants have a positively charged molecular head. Anionic surfactants have a negatively charged molecular head. Nonionic surfactants have no charge associated with the head of the molecule.

Nonionic Surfactants

Nonionic surfactants are molecules with neither a positive nor negatively charged head portion. Nonionic surfactants may include some of the following non-exhaustive list:

ethoxylated aliphatic alcohol, polyoxyethylene surfactants, carboxylic esters, polyethylene glycol esters, anhydrosorbitol ester and ethoxylated derivatives, glycol esters of fatty acids, carboxylic amides, monoalkanolamine condensates, and polyoxyethylene fatty acid amides.

Some aspects of the present disclosure include ethoxylated glycerol esters, ethoxylated sorbitans, and ethoxylated phosphate esters.

Ethoxylated Alcohols

Ethoxylation of an alcohol is a reaction in which ethylene oxide units are added to an alcohol molecule. During the reaction, R—OH is converted to $R(OC_2H_4)_nOH$ where n may equal 1 to 100. The converted alcohol becomes an alcohol ethoxylate. Alcohol ethoxylates are commonly used as surfactants in the cosmetic industry.

Large-scale production of alcohol ethoxylates are performed using fatty alcohols. Production begins using potassium hydroxide as a catalyst and includes blowing of ethylene oxide through the given alcohol at 180° C. and under 1 to 2 bar of pressure. In general, about 5 to 10 molecules of ethylene oxide may be added to each alcohol molecule.

Glycerin Ethoxylate (GLY7)

In certain aspects, the glycerin ethoxylate of the present disclosure includes a glycerin ethoxylate polyol. Polyols are generally used as reactants and come in the form of a polyether or a polyester molecule. Polyols are common reactants in transesterification, silane capping, and the production of surfactants and lubricants. Polyether polyols may be formed by reacting epoxides with a monomeric polyol in the presence of a catalyst, whereby the monomeric polyol serves as an initiator of the polymerization reaction to produce the polymeric polyol. Examples of epoxides relevant to this disclosure include ethylene oxide and propylene oxide. Examples of monomeric polyols relevant to this disclosure include glycerin, ethylene glycol, and sucrose. One non-limiting aspect of a suitable ethoxylated alcohol is glycerin ethoxylate.

Glycerin ethoxylate (7EO) (GLY7) is represented by the chemical formula $(C_2H_4O)_n\ C_3H_8O_3$ where it is preferred that n=7. That is, in some aspects, ethoxylated glycerin may be used with the addition of seven ethylene oxide molecules added to each glycerol molecule with a molecular structure as described below:

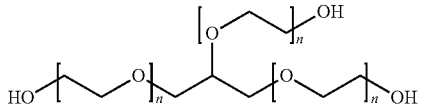

n = 7

Various aspects of the compound appear as a clear, viscous, colorless liquid, as a clear colorless liquid, white flakes, or as a waxy solid at 20 degrees Celsius (° C.).

Glycerin ethoxylate uses include the preparation of cosmetic materials, and are often included to provide texture to a product. In a related use, glycerin ethoxylate may also be used as a humectant to preserve moisture of the skin. Other common methods of employing glycerin ethoxylate include its use as a tackifier when incorporated into an adhesive and its use as an emulsifier in many applications in the construction industry.

In alternative aspects, the composition may include 4, or 5, or 6, or 8, or 9, or even 10 ethylene oxide molecules. In a further aspect, the composition may include 7 ethylene oxide molecules.

In further alternative aspects, ethoxylation may be combined with propoxylation substituting propylene oxide in lieu of ethylene oxide. That is, in certain aspects of the present disclosure, the alcohol may include one or more units of propylene oxide ($—OCH_2CH_2CH_2—$) instead of ethylene oxide.

In still further alternative aspects, ethoxylated alcohols may be converted to a corresponding organosulfate, which may then be converted to an anionic surfactant.

Anionic Surfactants

Anionic surfactants are molecules with a negatively charged hydrophilic head portion, and are the most commonly used class of surfactants. These compositions are particularly useful in keeping dislodged particles forming stains away from fabrics once removed.

Examples of anionic surfactants may include, but are not limited to, water-soluble alkali metal salts, ethylene oxide reaction products, carboxylates, sulfonates including, petroleum sulfonates, alkyl benzene sulfonates including linear alkyl benzene sulfonate, sodium alkyl benzene sulfonate and potassium alkyl benzene sulfonate, naphthalene sulfonates, olefin sulfonates, sulfates, alkyl sulfates including sodium alkyl sulfate, potassium alkyl sulfate, and sodium alkyl glycerol ether sulfate, sulfated natural oils and fats including sodium coconut oil fatty monoglyceride sulfate or sulfonate and products of coconut fatty acid esterified with isethionic acid and neutralized with sodium hydroxide, sulfated esters, sodium salt of sulfuric acid esters of higher fatty alcohol-alkylene, alpha methyl sulfo-ester of fatty acids, sodium and potassium salts of fatty acid amides of methyl taurine, alkane monosulfonates derived from an alpha-olefin (C8-C20) sodium bisulfite reaction, sulfated alkanolamides, and ethoxylated and sulfated alkylphenols.

In an aspect, an anionic surfactant may be used to remove stains at a polyester-cotton fabric caused by makeup or cosmetics in combination with glycerin ethoxylate.

Linear Alkyl Benzene Sulfonate (LABS)

An example of an anionic surfactant suitable in aspects of the present disclosure is linear alkyl benzene sulfonate. Linear alkyl benzene sulfonate (LABS) is represented by the chemical formula $C_{12}H_{25}C_6H_4SO_3$. In certain aspects, LABS may be represented by the molecular formula:

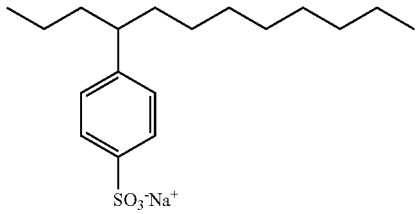

LAS: Linear Alkyl Benzene Sulfonate
(Alkyl Chain: $C_{10}$-$C_{13}$)

Various aspects of this compound appear as a clear, colorless, and odorless, liquid. Common uses of LABS include uses as a surfactant as well as an intermediate in the production of surfactants for household and industrial detergents and cleansers. Other uses as a component in wetting, dispersing and cleaning agents, and as a component in emulsifiers, polymerization processes, and crop protection agents are common.

In particular aspects, the linear alkyl chain may have 10, or 11, or 12, or even 13 carbon units.

In one particular aspect, LABS may be used in combination with glycerin ethoxylate (GLY7) at a 1:1 ratio by mass to remove stains including deposits of cosmetic material at a polyester-cotton fabric. In a specific example, the polyester-cotton fabric may have a polyester to cotton ratio of about 65:35.

Applications

The use of surfactant compositions extends across various applications including use in products such as, but not limited to, detergents, fabric softeners, emulsions, paints, adhesives, inks, anti-fog compositions, ski and snowboard waxes, deinking of recycled products, laxatives, herbicides, insecticides, and biocides, cosmetics including shampoos, hair conditioners, and toothpastes, spermicides, fire/flame retardants, drag reducing agents for piping and pipelines, ferrofluids, leak detectors, and alkali surfactant polymers for mobilizing oil in wells.

Stain Removal

Surfactant compositions are also commonly used to remove stains from an article. Deposits of material forming a stain may cause an unwanted appearance and may be removed from the article in a number of ways. Stain removal utilizing surfactant compositions involves the formation of micelle particles. Micelles are a group of surfactant molecules that congregate in a bulk aqueous phase, according to hydrophobic tails at the core of the micelle particle and hydrophilic heads in contact with the surrounding solution forming the outer wall of the particle. As the surfactant molecules congregate, the hydrophilic heads group together to form a spherical, cylindrical or lipid bilayer structure with the hydrophobic tails encapsulating the oil based deposit causing the stain. Once encapsulated, deposited stain material may be washed away with the aqueous phase of the surfactant solution, thereby improving the visual appearance of the stained article.

For example, an article of clothing stained with a coconut oil containing makeup or cosmetic product may be treated with a surfactant and water solution. The treatment of the stain with a surfactant-water solution causes the hydrophobic, or lipophilic tail portions of the surfactant molecules to be repelled from the water and concurrently drawn to the oil based deposit causing the stain. At the same time, the hydrophilic head portions of the surfactant molecules associate with the water molecules in solution. Accordingly, with the hydrophilic heads of the surfactant molecules facing outward, and the hydrophobic tails and oil based stain materials trapped in the core of the structure, the overall micelle formed is water-soluble, and will ultimately allow the stain to be removed from the article of clothing and improve the overall visual appearance of the article.

The compositions of the present disclosure demonstrate enhanced stain removal properties as measured by reflectance of light at 460 nm, representative of the wavelength of day light, that which is visible to the naked eye. Stain removal utilizing this measurement is based on the principle that a deposit of material on a white fabric would lower the reflectance of light, and the removal of such a deposit would increase the same. Thus, the higher the reflection of light, the greater the amount of deposited material removed, and the better overall performance of the treatment composition.

To assess anti-redeposition performance, a white fabric may be added along with the stained fabrics during a treatment of a fabric with a given composition. Reflectance of the unwashed, non-stained white fabric may be observed prior to a laundering and then observed after the wash trial with a given stained fabric. Reflectance values closer to that observed for the unwashed fabric may indicate that the detergent formulation is a suitable anti-redeposition agent.

In some aspects, treatment of a white polyester-cotton fabric (65:35) stained according to WFK 20MU with a 1:1 ratio of a glycerin ethoxylate (GLY7) and linear alkyl benzene sulfonate (LABS) composition (GLY7+LABS) results in an increase in stain removal measured as an increase in reflectance to about 70 from about 50 relative to an unwashed stained fabric. In alternative aspects, GLY7+LABS results in an increase in stain removal measured as an increase reflectance to about 65 from about 45 relative to an unwashed stained fabric. In a further alternative aspect, GLY7+LABS results in an increase in stain removal measured as reflectance to about 70 from about 55 relative to treatment utilizing GLY7 alone. In a still further aspect, GLY7+LABS results in an increase in stain removal measured as reflectance to about 70 from about 65 relative to treatment utilizing an anionic surfactant alone. In an even further aspect, GLY7+LABS results in an increase in stain removal measured as reflectance to about 70 from about 65 utilizing LABS alone.

In some aspects, performance of the disclosed composition exhibits an increased stain removal measured as reflectance of between about 35% and about 40% between treatment of a test fabric with 1:1 glycerin ethoxylate (GLY7) and linear alkyl benzene sulfonate (LABS) composition (GLY7+LABS) and an unwashed test fabric. Further aspects of the present disclosure exhibit an increased stain removal measured as reflectance of between about 15% and about 20% between treatment of a test fabric with GLY7+LABS and treatment of a test fabric with GLY7 alone. Still further aspects of the present disclosure exhibit an increased stain removal measured as reflectance of between about 1% and about 4.5% between treatment of a test fabric with GLY7+LABS and treatment of a test fabric with LABS alone.

ASPECTS

In various aspects, the present disclosure pertains to and includes at least the following aspects.

Aspect 1A. A composition for removing a cosmetic material from a substrate, the composition comprising: glycerin ethoxylate; and linear alkyl benzene sulfonate (LABS); wherein an application of the composition to a stain comprising a WFK 20MU deposit of a cosmetic material at a white polyester-cotton blend fabric exhibits an increased stain removal measured as reflectance observed at 460 nm by at least about 35% compared to a reflectance observed at the stained polyester-cotton blend fabric prior to the application; wherein a treatment of the stain removal composition applied to the stained polyester-cotton blend fabric provides a reflectance at the stained polyester-cotton blend fabric that is greater than a reflectance observed at a white polyester-cotton blend fabric stained with a WFK 20MU deposit of a cosmetic material and that has been treated with either the glycerin ethoxylate alone or that has been treated with the linear alkyl benzene sulfonate alone.

Aspect 1B. A composition for removing a cosmetic material from a substrate, the composition consisting of: glycerin ethoxylate; and linear alkyl benzene sulfonate (LABS); wherein an application of the composition to a stain comprising a WFK 20MU deposit of a cosmetic material at a white polyester-cotton blend fabric exhibits an increased stain removal measured as reflectance observed at 460 nm by at least about 35% compared to a reflectance observed at the stained polyester-cotton blend fabric prior to the application; wherein a treatment of the stain removal composition applied to the stained polyester-cotton blend fabric provides a reflectance at the stained polyester-cotton blend fabric that is greater than a reflectance observed at a white polyester-cotton blend fabric stained with a WFK 20MU deposit of a cosmetic material and that has been treated with either the glycerin ethoxylate alone or that has been treated with the linear alkyl benzene sulfonate alone.

Aspect 1C. A composition for removing a cosmetic material from a substrate, the composition consisting essentially of: glycerin ethoxylate; and linear alkyl benzene sulfonate (LABS); wherein an application of the composition to a stain comprising a WFK 20MU deposit of a cosmetic material at a white polyester-cotton blend fabric exhibits an increased stain removal measured as reflectance observed at 460 nm by at least about 35% compared to a reflectance observed at the stained polyester-cotton blend fabric prior to the application; wherein a treatment of the stain removal composition applied to the stained polyester-cotton blend fabric provides a reflectance at the stained polyester-cotton blend fabric that is greater than a reflectance observed at a white polyester-cotton blend fabric stained with a WFK 20MU deposit of a cosmetic material and that has been treated with either the glycerin ethoxylate alone or that has been treated with the linear alkyl benzene sulfonate alone.

Aspect 2. The composition of any one of Aspects 1A to 1C, wherein the application of the composition to the stain comprising the deposit of the cosmetic material at the white polyester-cotton blend fabric increases stain removal measured as reflectance observed at 460 nm by at least about 40% compared to the reflectance observed at the stained polyester-cotton blend fabric prior to the treatment.

Aspect 3. The composition of any one of Aspects 1A to 2, wherein the polyester-cotton blend fabric exhibits an increased stain removal measured as reflectance observed at 460 nm by at least about 1% compared to the reflectance observed at the stained polyester-cotton blend fabric treated with linear alkyl benzene sulfonate (LABS) alone.

Aspect 4. The composition of any one of Aspects 1A to 3, wherein the polyester-cotton blend fabric exhibits an increased stain removal measured as reflectance observed at 460 nm by at least about 4.5% compared to the reflectance observed at the stained polyester-cotton blend fabric treated with linear alkyl benzene sulfonate (LABS) alone.

Aspect 5. The composition of any one of Aspects 1A to 4, wherein the polyester-cotton blend fabric exhibits an increased stain removal measured as reflectance observed at 460 nm by at least about 15% compared to the reflectance observed at the stained polyester-cotton blend fabric treated with glycerin ethoxylate alone.

Aspect 6. The composition of any one of Aspects 1A to 4, wherein the polyester-cotton blend fabric exhibits an increased stain removal measured as reflectance observed at 460 nm by at least about 20% compared to the reflectance observed at the stained polyester-cotton blend fabric treated with glycerin ethoxylate alone.

Aspect 7A. A composition for removing a cosmetic material from a substrate, the composition comprising glycerin ethoxylate; and linear alkyl benzene sulfonate (LABS); wherein an application of the composition to a stain comprising a WFK 20MU deposit of a cosmetic material at a white polyester-cotton blend fabric exhibits an increased reflectance value observed at 460 nm of about 70 compared to a reflectance value observed at the stained polyester-cotton blend fabric of about 50 prior to the application.

Aspect 7B. A composition for removing a cosmetic material from a substrate, the composition consisting of glycerin ethoxylate; and linear alkyl benzene sulfonate (LABS); wherein an application of the composition to a stain comprising a WFK 20MU deposit of a cosmetic material at a white polyester-cotton blend fabric exhibits an increased reflectance value observed at 460 nm of about 70 compared to a reflectance value observed at the stained polyester-cotton blend fabric of about 50 prior to the application.

Aspect 7C. A composition for removing a cosmetic material from a substrate, the composition consisting essentially of glycerin ethoxylate; and linear alkyl benzene sulfonate (LABS); wherein an application of the composition to a stain comprising a WFK 20MU deposit of a cosmetic material at a white polyester-cotton blend fabric exhibits an increased reflectance value observed at 460 nm of about 70 compared to a reflectance value observed at the stained polyester-cotton blend fabric of about 50 prior to the application.

Aspect 8. The composition of any one of Aspects 7A to 7C, wherein the application of the composition to the stain comprising the deposit of the cosmetic material at the white polyester-cotton blend fabric exhibits an increased reflectance value observed at 460 nm of about 65 compared to a reflectance value observed at the stained polyester-cotton blend fabric of about 45 prior to the application.

Aspect 9. The composition of any one of Aspects 7A to 7C, wherein the application of the composition to the stain comprising the deposit of the cosmetic material at the white polyester-cotton blend fabric provides a reflectance value of about 70 at the stained polyester-cotton blend fabric compared to a reflectance value of about 55 observed at the stained polyester-cotton blend fabric that has had only a glycerin ethoxylate application.

Aspect 10. The composition of any one of Aspects 7A to 7C, wherein the application of the composition to the stain comprising the deposit of the cosmetic material at the white polyester-cotton blend fabric provides a reflectance value of about 70 at the stained polyester-cotton blend fabric compared to a reflectance value of about 65 observed at the stained polyester-cotton blend fabric that has had only a linear alkyl benzene sulfonate (LABS) application.

Aspect 11. The composition of any one of Aspects 1A to 10, wherein glycerin ethoxylate and linear alkyl benzene sulfonate (LABS) are combined at a ratio of about 1:1 by mass.

Aspect 12A. A composition for removing a cosmetic material from a substrate, the composition comprising glycerin ethoxylate; and an anionic surfactant, wherein an application of the composition to a stain comprising a WFK 20MU deposit of a cosmetic material at a white polyester-cotton blend fabric exhibits an increased stain removal measured as reflectance observed at 460 nm by at least about 35% compared to a reflectance observed at the stained polyester-cotton blend fabric prior to the application; and wherein a treatment of the stain removal composition applied to the stained polyester-cotton blend fabric provides a reflectance at the stained polyester-cotton blend fabric that is greater than a reflectance observed at a stained polyester-cotton blend fabric with a WFK 20MU deposit of a cosmetic material and that has been treated with either the glycerin ethoxylate alone or that has been treated with the anionic surfactant alone.

Aspect 12B. A composition for removing a cosmetic material from a substrate, the composition consisting of glycerin ethoxylate; and an anionic surfactant, wherein an application of the composition to a stain comprising a WFK 20MU deposit of a cosmetic material at a white polyester-cotton blend fabric exhibits an increased stain removal measured as reflectance observed at 460 nm by at least about 35% compared to a reflectance observed at the stained polyester-cotton blend fabric prior to the application; and wherein a treatment of the stain removal composition applied to the stained polyester-cotton blend fabric provides a reflectance at the stained polyester-cotton blend fabric that is greater than a reflectance observed at a stained polyester-cotton blend fabric with a WFK 20MU deposit of a cosmetic material and that has been treated with either the glycerin ethoxylate alone or that has been treated with the anionic surfactant alone.

Aspect 12C. A composition for removing a cosmetic material from a substrate, the composition consisting essentially of glycerin ethoxylate; and an anionic surfactant, wherein an application of the composition to a stain comprising a WFK 20MU deposit of a cosmetic material at a white polyester-cotton blend fabric exhibits an increased stain removal measured as reflectance observed at 460 nm by at least about 35% compared to a reflectance observed at the stained polyester-cotton blend fabric prior to the application; and wherein a treatment of the stain removal composition applied to the stained polyester-cotton blend fabric provides a reflectance at the stained polyester-cotton blend fabric that is greater than a reflectance observed at a stained polyester-cotton blend fabric with a WFK 20MU deposit of a cosmetic material and that has been treated with either the glycerin ethoxylate alone or that has been treated with the anionic surfactant alone.

Aspect 13. The composition of any one of Aspects 12A to 12C, wherein application of the composition to the stain comprising the WFK 20MU at the white polyester-cotton blend fabric increases stain removal measured as reflectance observed at 460 nm by at least about 40% compared to the reflectance observed at the stained polyester-cotton blend fabric prior to the treatment.

Aspect 14. The composition of any one of Aspects 12A to 13, wherein the polyester-cotton blend fabric exhibits an increased stain removal measured as reflectance observed at 460 nm by at least about 1% compared to the reflectance observed at the stained polyester-cotton blend fabric treated with the anionic surfactant alone.

Aspect 15. The composition of any one of Aspects 12A to 14, wherein the polyester-cotton blend fabric exhibits an increased stain removal measured as reflectance observed at 460 nm by at least about 4.5% compared to the reflectance observed at the stained polyester-cotton blend fabric treated with the anionic surfactant alone.

Aspect 16. The composition of any one of Aspects 12A to 15, wherein the polyester-cotton blend fabric exhibits an increased stain removal measured as reflectance observed at 460 nm by at least about 15% compared to the reflectance observed at the stained polyester-cotton blend fabric treated with glycerin ethoxylate alone.

Aspect 17. The composition of any one of Aspects 12A to 16, wherein the polyester-cotton blend fabric exhibits an increased stain removal measured as reflectance observed at 460 nm by at least about 20% compared to the reflectance observed at the stained polyester-cotton blend fabric treated with glycerin ethoxylate alone.

Aspect 18. The composition of any one of Aspects 12A to 17, wherein the anionic surfactant is a water-soluble alkali metal salt.

Aspect 19. The composition of Aspect 18, wherein the anionic surfactant is one of a sodium alkyl sulfate, potassium alkyl sulfate, sodium alkyl benzene sulfonate, potassium alkyl benzene sulfonate, sodium alkyl glycerol ether sulfate, sodium coconut oil fatty monoglyceride sulfate or sulfonate, sodium salt of sulfuric acid ester of higher fatty alcohol-alkylene, ethylene oxide reaction product, alpha methyl sulfo-ester of fatty acids, product of coconut fatty acid esterified with isethionic acid and neutralized with sodium hydroxide; sodium and potassium salts of fatty acid amides of methyl taurine, alkane monosulfonates derived from an alpha-olefin (C8-C20) sodium bisulfite reaction, and olefin sulfonate, or a combination thereof.

Aspect 20. The composition of any one of Aspects 1A to 19, wherein the treatment includes a 30 minute wash step applying the composition at about 200 rpm and a drying step at about 23° C. or about room temperature; and wherein the composition is applied at a load of about 25 g/L and at a dosage of about 0.4% weight by volume.

Aspect 21. The composition of any one of Aspects 1A to 20, wherein the glycerin ethoxylate comprises seven ethylene oxide units.

Aspect 22. The composition of any one of Aspects 1A to 21, wherein an ethoxylated sorbitan is used in place of glycerin ethoxylate.

Aspect 23. The composition of any one of Aspects 1A to 20, wherein an ethoxylated glycerol ester is used in place of glycerin ethoxylate.

Aspect 24. The composition of any one of Aspects 1A to 20, wherein an ethoxylated phosphate ester is used in place of glycerin ethoxylate.

Aspect 25. The composition of any one of Aspects 1A to 24, wherein glycerin ethoxylate may appear as one of a clear, viscous, colorless liquid or as a clear, colorless liquid, or as white flakes, or as a waxy solid at 20° C.

Aspect 26. The composition of any one of Aspects 1A to 25, wherein glycerin ethoxylate may include 4, or 5, or 6, or 8, or 9, or 10 ethylene oxide molecules.

Aspect 27. The composition of any one of Aspects 1A to 26, wherein propylene oxide may be used in place of ethylene oxide.

Aspect 28. The composition of any one of Aspects 1A to 27, wherein the anionic surfactant is formed by converting an ethoxylated alcohol to a corresponding organosulfate, and converting the organosulfate to the anionic surfactant.

Aspect 29. The composition of any one of Aspects 1A to 28, wherein linear alkyl benzene sulfonate (LABS) may include 10, or 11, or 12, or 13 carbon units.

EXAMPLES

The stain removal properties of the disclosed composition were tested as discussed below.

Myriad staining compositions may cause unwanted marks on fabrics. Accordingly, testing against such a variety of stains has been standardized. Individual stain identities may include, but are not limited to, apple juice, beef lard, blackberry juice, black currant juice, blood, blueberry juice, butterfat with colorant, carrot baby food, carrot juice, chocolate, chocolate cream, chocolate milk/carbon black, clay, Coca Cola™, cocoa (temperature treated/untreated), cocoa/lanolin, coffee, corn starch, curry, egg (temperature treated/untreated), French squeezy mustard, fruit juice, frying fat (hamburger grease), grass/mud, ink, ketchup, lipstick, mayonnaise, mayonnaise/carbon black, mineral oil, mustard, olive oil, olive oil/soot, organic carrot & potato baby food, pigment/lanolin, pigment/olive oil, pigment/vegetable fat, pigment oil (>60° C.)/(<60° C.), pigment oil (for industrial laundry), pigment/vegetable oil/milk, pigment/vegetable oil/low milk, porridge, potato starch, pudding (mananase sensitive), red beet, red currant juice, red pepper (paprika), red wine/aged red wine, rice starch, salad dressing/natural black, sebum/pigment, shoe polish, soot mineral oil, soy sauce, spinach, strawberry, tapioca starch (colored), tea/tea for medium and high temperature, tomato (double applied), tomato beef sauce, tomato puree, used/unused motor oil, vegetable oil chlorophyll, and makeup.

Makeup stains may occur on a number of fabrics including cotton, polyester, polyester/cotton blend, wool, and silk. In some aspects, the makeup stained fabric may be a fabric having a makeup stain according to a WFK stain type commercially available from Testgewebe GmbH stain types. WFK Testgewebe GmbH stain types and fabric types are available for a number of stains and fabrics including a number of the stains described herein. Polyester stained with makeup is referenced as WFK 30MU according to WFK Testgewebe GmbH. Wool and silk marred by makeup are referenced as WFK 60MU and WFK 70MU, respectively, according to WFK Testgewebe GmbH. For purposes of this application, a polyester/cotton blend assigned the reference WFK 20MU according to WFK Testgewebe GmbH is used.

A deposit of makeup, or cosmetic material in accordance with the standard WFK 20MU was applied to a white polyester-cotton test fabric having a ratio of 65:35 polyester to cotton. After affixing the stain to the test fabric, the test fabric was subjected to a treatment with a tergotometer or left untreated. Treated fabrics underwent a washing step whereby the stained test fabric was washed at 200 rpm in a treatment solution for 30 minutes at 40° C. Four sample test fabrics were tested leaving one unwashed sample as a standard against which the stain removal performance of the three treatment compositions would be measured for reflectance of light at 460 nm, as a wavelength representative of day light. Given the measurement at daylight, visibility of the stain to the naked eye may follow. Thus, the stains and their corresponding washed iterations have been measured to quantify the extent of stain removal apparent to the naked eye. Measurement of reflectance of light was performed by a Konica Minolta spectrophotometer. Each of the three treatment compositions was formulated with distilled water to form a treatment solution.

A first treatment composition of glycerin ethoxylate (7EO) was formulated and applied to the test fabric at a load of about 25 grams per liter (g/L) in distilled water. Treatment of the fabric with the single composition was performed at a dose of about 0.4% glycerin ethoxylate.

A second treatment composition of linear alkyl benzene sulfonate (LABS) was formulated and applied to a test fabric at a load of about 25 g/L in distilled water. Treatment of the fabric with the single composition was performed at a dose of about 0.4% weight by volume of glycerin ethoxylate. An alternative aspect of the disclosed composition may include treatment utilizing an anionic surfactant according to any one of the compounds described as an anionic surfactant above.

A third treatment composition of glycerin ethoxylate and LABS was formulated in a 1:1 ratio by mass and applied to a test fabric at a load of about 25 g/L in distilled water. Treatment of the fabric with the blended composition was performed at a dose of about 0.4% weight by volume of glycerin ethoxylate-LABS. An alternative aspect of the disclosed composition may include treatment utilizing an anionic surfactant according to any one of the compounds described as an anionic surfactant above with glycerin ethoxylate.

After the sample test fabrics were washed as described above, the polyester-cotton blends were thoroughly rinsed with distilled water and then allowed to dry at room temperature, or at about 23° C.

Measurements of reflectance at 460 nm using a spectrophotometer were based on the principle that a deposit of material on a white fabric would lower the reflectance of light and the removal of such a deposit would increase the same. Thus, the higher the reflection of light, the greater the amount of deposited material removed and the better overall performance of the treatment composition.

Results of each treatment composition are found in Table 1 below. GLY7 represents treatment of a sample test fabric with glycerin ethoxylate alone. LABS represents treatment of a sample test fabric with linear alkyl benzene sulfonate alone. GLY7+LABS represents treatment of a sample test fabric with a blend of glycerin ethoxylate and linear alkyl benzene sulfonate at a 1:1 ratio.

TABLE 1

Laundry Wash Trial (Method: Tergotometer (TM), deionized water, 40° C., 200 revolutions per minute (rpm), 30 min, load 25 g/L, dosage 0.4% weight by volume, RT drying, polyester-cotton blend (65:35)

| | Percent Reflectance at 460 nm | | | |
|---|---|---|---|---|
| Stain Type | Unwashed Fabric | GLY7 | LABS | GLY7 + LABS |
| Makeup (WFK 20MU) | 49.6 | 58.4 | 68.1 | 71.2 |

As described above, results from these experiments indicated that glycerin ethoxylate mixed with the anionic surfactant linear alkyl benzene sulfonate cooperate effectively to eliminate cosmetic staining from a polyester-cotton test fabric. FIG. 1 presents the observed reflectance values as a chart.

Using an unwashed test fabric with a makeup stain according to WFK 20MU, a baseline stain reflectance of 49.6 at 460 nm was observed. With respect to each of the treatment compositions, it was found that the 1:1 ratio of glycerin ethoxylate and linear alkyl benzene sulfonate demonstrated the greatest overall removal of makeup stain based on reflectance at 460 nm.

Treatment with the first composition using glycerin ethoxylate alone yielded a stain removal measured as reflectance of 58.4 at 460 nm. Treatment with the second composition using linear alkyl benzene sulfonate resulted in a stain removal measured as reflectance of 68.1 at 460 nm. Finally, treatment with the third composition using a combined mixture of linear alkyl benzene sulfonate and glycerin ethoxylate at a 1:1 ratio resulted in an even greater removal of stain yielding a reflectance of 71.2 at 460 nm.

Stain removal apparent to the naked eye may require a difference in reflectance between any two samples of at least 2 reflectance units. Accordingly, the difference in reflectance of 8.8 between the unwashed test fabric (49.6) and the treatment with the first composition using glycerin ethoxylate alone (58.4) was apparent to the naked eye. The difference in reflectance of 18.5 between the unwashed test fabric and the treatment with the second composition using linear alkyl benzene sulfonate alone (68.1) represented a more visibly appreciable loss of stain. However, the difference in reflectance of 21.6 between the unwashed test fabric and the treatment with the third composition using a combined mixture of linear alkyl benzene sulfonate and glycerin ethoxylate at a 1:1 ratio (71.2) achieved the greatest, and thus, the most aesthetically pleasing, elimination of the makeup stain.

In relative percentages, experimental results show an increased stain removal measured as reflectance of about 43.5% between treatment of a test fabric with 1:1 glycerin ethoxylate and linear alkyl benzene sulfonate and an unwashed test fabric. In comparison of treatment compositions directly, experimental results demonstrate an increased stain removal measured as reflectance of about 21.9% between treatment of a test fabric with 1:1 glycerin ethoxylate and linear alkyl benzene sulfonate and treatment of a test fabric with glycerin ethoxylate (GLY7) alone. Experimental results further showed an increased stain removal measured as reflectance of about 4.6% between treatment of a test fabric with 1:1 glycerin ethoxylate and linear alkyl benzene sulfonate and treatment of a test fabric with linear alkyl benzene sulfonate (LABS) alone.

Given the dynamic properties of the combination of glycerin ethoxylate and the anionic surfactant linear alkyl benzene sulfonate, the disclosed composition exhibits synergistic properties to further enhance makeup stain removal characteristics relative to either of compounds used as a surfactant alone.

Any publications mentioned herein are incorporated herein by reference to disclose and describe the methods and/or materials in connection with which the publications are cited.

It is also to be understood that the terminology used herein is for the purpose of describing particular aspects only and is not intended to be limiting. As used in the specification and in the claims, the term "comprising" may include the aspects or aspects "consisting of" and "consisting essentially of." Unless defined otherwise, all technical and scientific terms used herein have the same meaning as commonly understood by one of ordinary skill in the art to which this disclosure belongs. In this specification and in the claims which follow, reference will be made to a number of terms which shall be defined herein.

As used in the specification and the appended claims, the singular forms "a," "an" and "the" include plural referents unless the context clearly dictates otherwise. Thus, for example, reference to "a glass fiber" includes mixtures of two or more such glass fibers.

Ranges can be expressed herein as from one value (first value) to another value (second value). When such a range is expressed, the range includes in some aspects one or both of the first value and the second value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit falling within a range between two particular units are also disclosed. For example, if 10 and 15 are disclosed, then 11, 12, 13, and 14 are also disclosed.

Disclosed are the components to be used to prepare disclosed compositions of the disclosure as well as the compositions themselves to be used within methods disclosed herein. These and other materials are disclosed herein, and it is understood that when combinations, subsets, interactions, groups, etc. of these materials are disclosed that while specific reference of each various individual and collective combinations and permutation cannot be explicitly disclosed, each is specifically contemplated and described herein. This concept applies to all aspects of this application including, but not limited to, steps in methods of making and using the compositions of the disclosure. Thus, if there are a variety of additional steps that can be performed it is understood that each of these additional steps can be performed with any specific aspect or combination of aspects of the methods of the disclosure.

References in the specification and concluding claims to parts by weight, of a particular component in a composition or article, denotes the weight relationship between the element or component and any other elements or components in the composition or article for which a part by weight is expressed. Thus, in a composition containing 2 parts by weight of component X and 5 parts by weight component Y, X and Y are present at a weight ratio of 2:5, and are present in such ratio regardless of whether additional components are contained in the compound.

A weight percent of a component, unless specifically stated to the contrary, is based on the total weight of the formulation or composition in which the component is included. For example if a particular element or component in a composition or article is said to have 8% weight, it is understood that this percentage is relation to a total compositional percentage of 100%.

Each of the component starting materials disclosed herein are either commercially available and/or the methods for the production thereof are known to those of skill in the art.

It will be apparent to those skilled in the art that various modifications and variations can be made in the present disclosure without departing from the scope or spirit of the disclosure. Other aspects of the disclosure will be apparent to those skilled in the art from consideration of the specification and practice of the disclosure disclosed herein. It is intended that the specification and examples be considered as exemplary on with a true scope and spirit of the disclosure being indicated by the following claims.

What is claimed is:

1. A composition consisting of glycerin ethoxylate and linear alkyl benzene sulfonate; wherein a mass ratio of glycerin ethoxylate to linear alkyl benzene sulfonate is 1:1.

2. The composition of claim 1, wherein the linear alkyl benzene sulfonate is of the formula

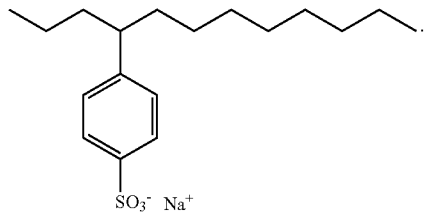

3. The composition of claim 1, wherein the glycerin ethoxylate consists of formula

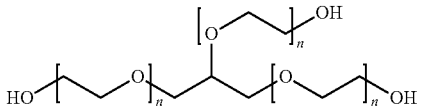

wherein n=7.

* * * * *